US009573663B2

(12) United States Patent
Constant, Jr. et al.

(10) Patent No.: US 9,573,663 B2
(45) Date of Patent: Feb. 21, 2017

(54) BOAT ANCHOR HOOK

(71) Applicants: Charles William Constant, Jr., Slidell, LA (US); Charles William Constant, III, Slidell, LA (US)

(72) Inventors: Charles William Constant, Jr., Slidell, LA (US); Charles William Constant, III, Slidell, LA (US)

( * ) Notice: Subject to any disclaimer, the term of this patent is extended or adjusted under 35 U.S.C. 154(b) by 0 days.

(21) Appl. No.: 14/542,135

(22) Filed: Nov. 14, 2014

(65) Prior Publication Data

US 2016/0137269 A1 May 19, 2016

(51) Int. Cl.
*B63B 21/54* (2006.01)

(52) U.S. Cl.
CPC ..... *B63B 21/54* (2013.01)

(58) Field of Classification Search
CPC ..... B63B 9/00; B63B 21/00; B63B 21/54; B63B 21/04; B63B 21/22
USPC ..... 114/221 R, 230.25, 230.26
See application file for complete search history.

(56) References Cited

U.S. PATENT DOCUMENTS

| | | | | |
|---|---|---|---|---|
| 2,811,127 | A * | 10/1957 | Palsson | B63B 21/54 114/221 R |
| 3,799,099 | A * | 3/1974 | Conover | B63B 21/54 114/221 R |
| 4,785,509 | A * | 11/1988 | Fisher | B63B 21/54 114/230.3 |
| 5,381,749 | A * | 1/1995 | Larson | B63B 21/54 114/221 R |
| 8,272,342 | B1 * | 9/2012 | Manuel, Jr. | B63B 21/20 114/230.25 |
| 2003/0116074 | A1 * | 6/2003 | Williams | B63B 21/00 114/221 R |

* cited by examiner

*Primary Examiner* — Lars A Olson
(74) *Attorney, Agent, or Firm* — Dunlap Bennett & Ludwig PLLC

(57) ABSTRACT

A boat hook anchor is provided. The boat hook anchor may include a metal tubing, such as electrical conduit metallic tubing. An insulating foam may be disposed within the metal tubing. The present invention may further include an anchor shackle attached to the second end of the metal tubing. The anchor shackle enables attachment of the anchor system to the boat. The anchor shackle may include a hoop securable to a rope attached to the boat.

6 Claims, 3 Drawing Sheets

BOAT ANCHOR HOOK

BACKGROUND OF THE INVENTION

The present invention relates to a boat anchor hook and, more particularly, to a hook used to anchor a boat to an above water structure.

Boaters find it difficult anchoring to above water surface structures. The only anchoring systems presently available for above water structures are ropes. The inabilities to get close enough due to sea conditions and water depth makes it difficult to use tradition boat anchoring systems. Damage to the boat and the risk of injury is a major concern.

As can be seen, there is a need for an improved device to hooking a boat to an above water structure.

SUMMARY OF THE INVENTION

In one aspect of the present invention, a method of anchoring a boat to an above water structure comprises: providing a boat in a body of water; providing a hook, wherein the hook is attached to the boat by a rope; directing the boat towards the above water structure; and hooking the hook on the above water structure, thereby anchoring the boat to the above water structure.

In another aspect of the present invention, a boat hook anchor comprises: a metal tubing comprising a first end, a second end, and a bend forming a hook; an insulating foam within the metal tubing; and an anchor shackle attached to the second end of the metal tubing, wherein the anchor shackle comprises a hoop securable to a rope attached to a boat.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes a "J" shaped metal hook designed for anchoring boats to various above water structures. The hook anchoring system provides a safe and easy way for boaters to anchor to above water structures. By simply attaching to the structure at a safe distance by using a hook, a boater can safely anchor without the risk of injury or damage to their boat.

Figure 1:
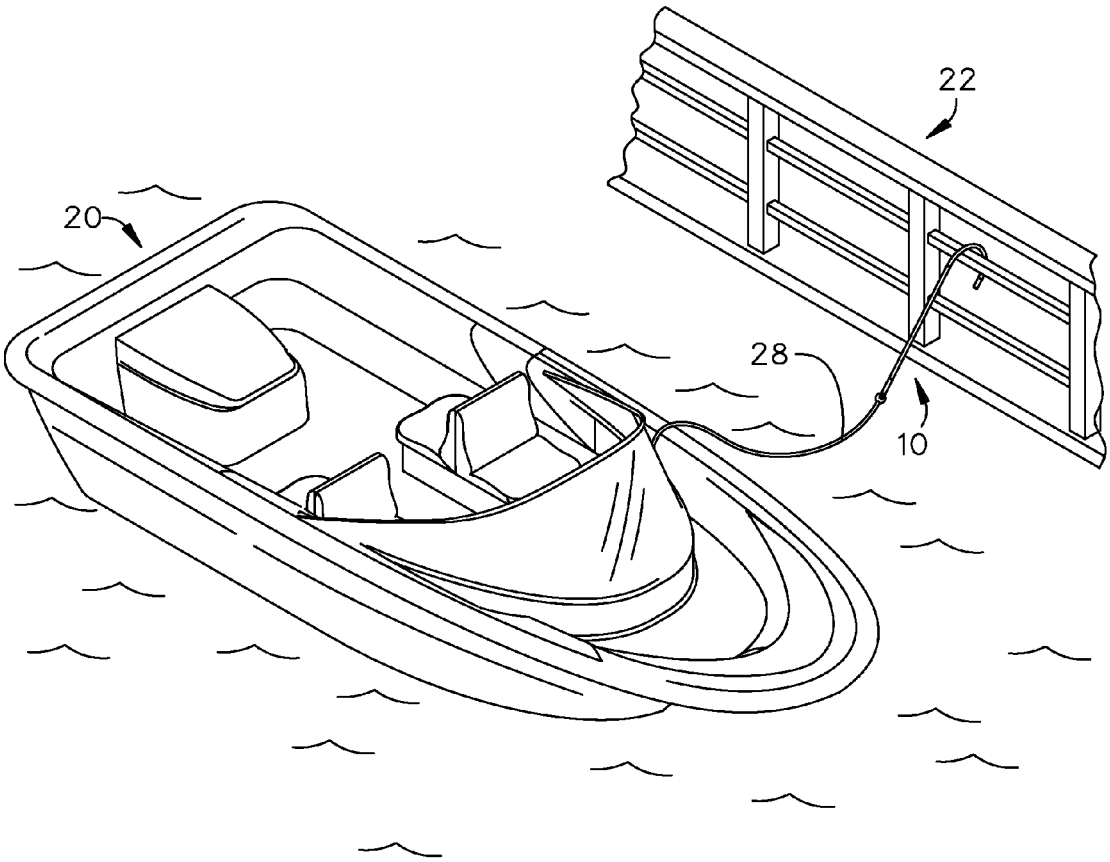
FIG. 1 is a perspective view of the present invention shown in use.
Figure 2:
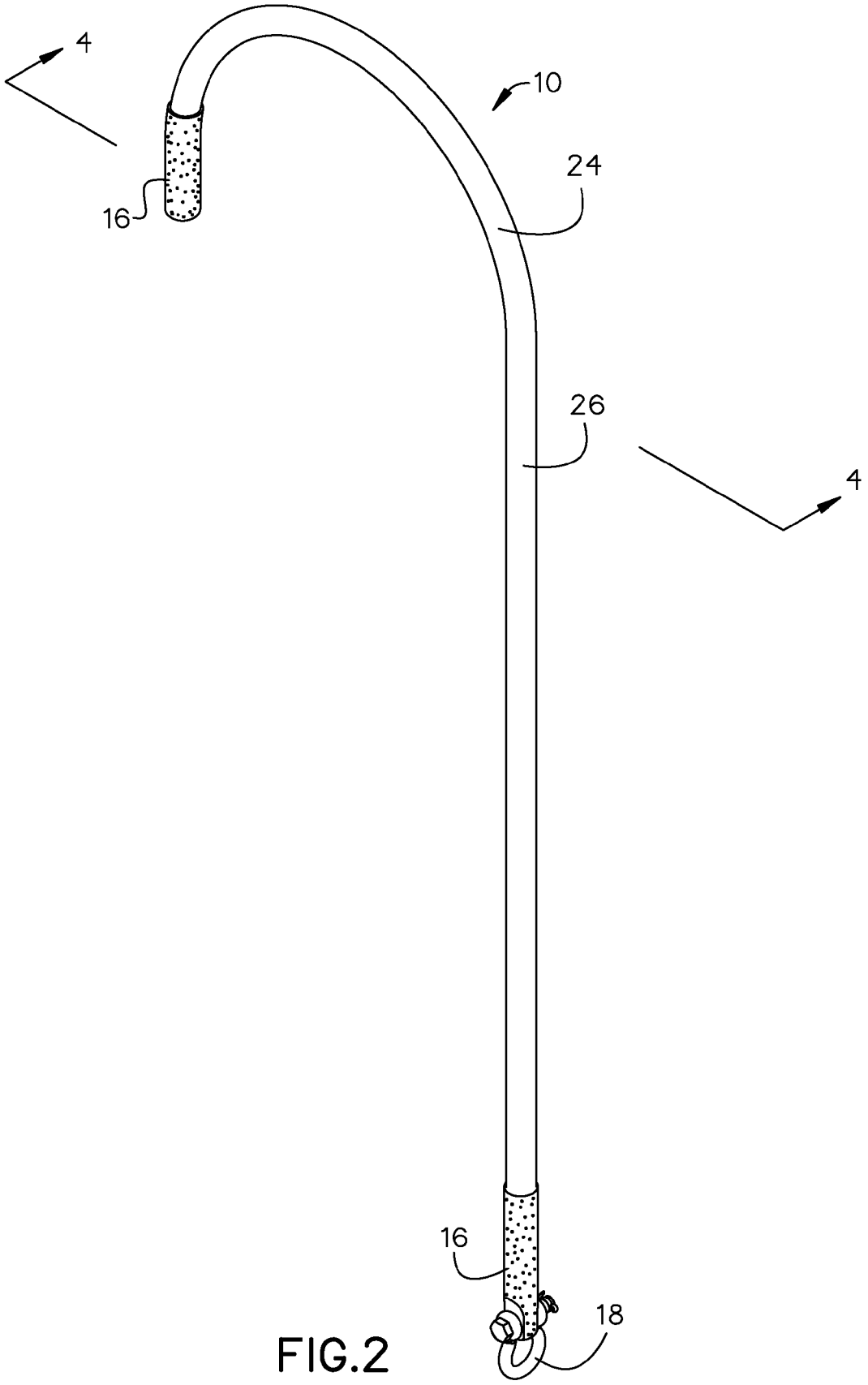
FIG. 2 is a perspective view of the present invention.
Figure 3:
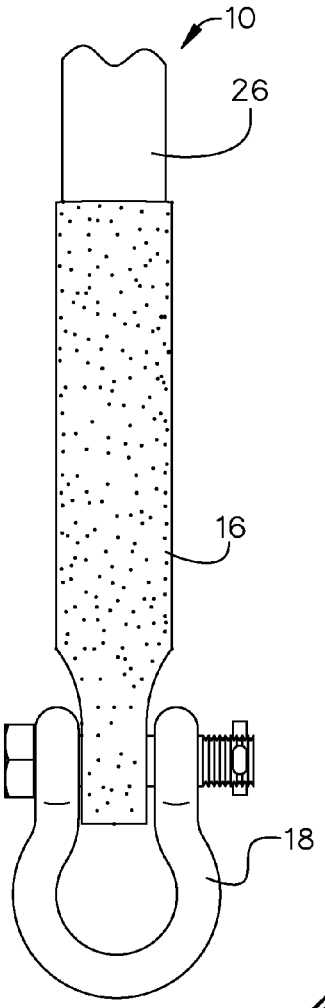
FIG. 3 is a detail side view of the present invention.
Figure 4:
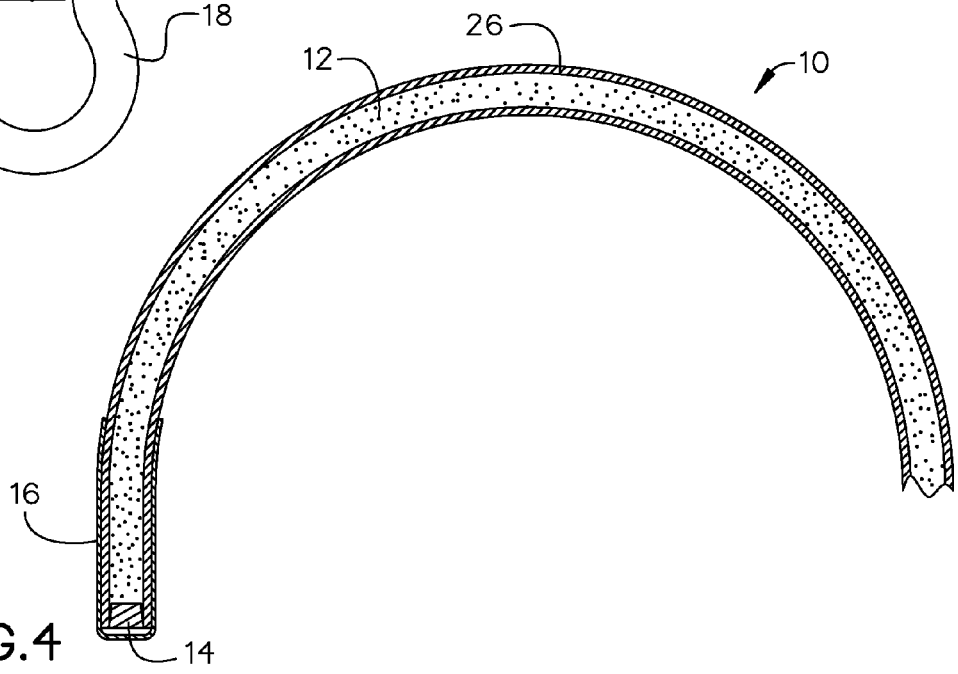
FIG. 4 is a detail section view of the present invention along line 4-4 in FIG. 2.

Referring to FIGS. 1 through 4, the present invention includes a boat hook anchor 10. The boat hook anchor 10 may include a metal tubing 26, such as electrical conduit metallic tubing. An insulating foam 12 may be disposed within the metal tubing 26. The present invention may further include an anchor shackle 18 attached to the second end of the metal tubing 26. The anchor shackle 18 enables attachment of the anchor system to the boat 20. The anchor shackle 18 may include a hoop securable to a rope 28 attached to the boat 20.

In certain embodiments, the metal tubing 26 of the present invention may be hollow from the first end to the second end, forming openings at each end. The insulating foam 12 may therefore run from the first end to the second end, and fill the hollow interior. The insulating foam 12 may strengthen the present invention and prevent the hook anchor 10 from bending or breaking.

To seal the insulating foam 12 within the hollow tubing 26, a sealing cork 14 may be secured within the opening of the first end. The sealing cork 14 seals the top end and creates a smooth end. The present invention may further include a first rubber sealer 16 covering the first end, and a second rubber sealer 16 covering the second end. The rubber sealers 16 may cover the openings with a water proof material, and may further prevent damage to the boat 20.

The anchor 10 of the present invention may be in the shape of a hook. The metal tubing 26 may include a bend 24 that forms the hook. The bend 24 may be 180 degrees so that the first end is directed to face towards the second end. Therefore, the bend 24 may be hooked on to the above water structure 22.

A method of making the present invention may include the following. The metal tubing 26 is bent at a 30 degree angle at each 5, 10, 15, and 20 inches intervals from the top to create a J shaped bend in the tubing. Then the metal tubing 26 is filled with the insulating foam sealant 12 and allowed time to dry and harden. A ⅜" hole is drilled ¾ of an inch from the bottom of the metal tubing 26. Then, the bottom 2 inches of the metal tubing 26 is compressed to ⅝ of an inch. Next, the sealing cork 14 is inserted into the top of the metal tubing 26 until it is even with the edge. Then, the rubber coating 16 is applied at each tip of the metal tubing 26 up to 5 inches coating at each end. Last, the anchor shackle 18 is fastened through the ⅜ hole drilled at the bottom end of the metal tubing 26.

A method of anchoring a boat to an above water structure may include the following. A boat having a hook attached to the boat by a rope is provided. The boat may be within a body of water and may be directed towards the above water structure. The hook may be hooked to the above water structure, thereby anchoring the boat to the above water structure.

It should be understood, of course, that the foregoing relates to exemplary embodiments of the invention and that modifications may be made without departing from the spirit and scope of the invention as set forth in the following claims.

What is claimed is:

1. A method of anchoring a boat to an above water structure comprising:

providing a boat in a body of water;

providing a hook comprising a hollow metal tubing having a first end, a second end and a bend formed in between the first end and the second end and an insulating foam disposed within the hollow metal tubing from the first end to the second end, wherein the hook is attached to the boat by a rope;

directing the boat towards the above water structure; and hooking the hook on the above water structure, thereby anchoring the boat to the above water structure.

2. The method of claim 1, wherein a first rubber sealer covers the first end and a second rubber sealer covers the second end.

3. A boat hook anchor comprising:

a hollow metal tubing comprising a first open end, a second open end, and a bend in between the first open end and the second open end forming a hook;

an insulating foam disposed within the hollow metal tubing running from the first end to the second end;

a first rubber sealer covering the first open end and a second rubber sealer covering the second open end; and an anchor shackle attached to the second open end of the metal tubing, wherein the anchor shackle comprises a hoop securable to a rope attached to a boat.

4. The boat hook anchor of claim 3, further comprising a sealing cork within the first end of the hollow metal tubing.

5. The boat hook anchor of claim 3, wherein the bend is 180 degrees.

6. The boat hook anchor of claim 3, wherein the first open end is directed to face towards the second open end.

* * * * *